US012595949B2

(12) United States Patent
Kim et al.

(10) Patent No.: US 12,595,949 B2
(45) Date of Patent: Apr. 7, 2026

(54) REFRIGERATOR HAVING A PLURALITY OF ICE MAKERS

(71) Applicant: LG ELECTRONICS INC., Seoul (KR)

(72) Inventors: Yong Hyun Kim, Seoul (KR); Soo Young Choi, Seoul (KR); Sunghee Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 236 days.

(21) Appl. No.: 18/102,226

(22) Filed: Jan. 27, 2023

(65) Prior Publication Data

US 2023/0243565 A1 Aug. 3, 2023

(30) Foreign Application Priority Data

Jan. 28, 2022 (KR) ..... 10-2022-0013468

(51) Int. Cl.
*F25C 1/25* (2018.01)
*F25C 1/04* (2018.01)
*F25D 29/00* (2006.01)

(52) U.S. Cl.
CPC ..... *F25C 1/25* (2018.01); *F25C 1/04* (2013.01); *F25D 29/005* (2013.01); *F25C 2400/06* (2013.01); *F25C 2400/08* (2013.01); *F25C 2400/14* (2013.01); *F25C 2600/04* (2013.01); *F25D 2323/121* (2013.01); *F25D 2323/122* (2013.01); *F25D 2331/806* (2013.01)

(58) Field of Classification Search
CPC .... F25C 1/04; F25C 2400/06; F25C 2400/14; F25C 2600/04
See application file for complete search history.

(56) References Cited

U.S. PATENT DOCUMENTS 5,737,932 A * 4/1998 Lee ..... F25D 23/126 62/340
9,518,774 B2 * 12/2016 Miller ..... F25C 5/182
2012/0111031 A1 * 5/2012 Lee ..... F25D 23/126 62/126
2012/0111048 A1 * 5/2012 Kim ..... F25C 1/10 62/340
2021/0003333 A1 * 1/2021 Kang ..... F25C 5/22

FOREIGN PATENT DOCUMENTS

KR 2014-0040395 A 4/2014

* cited by examiner

*Primary Examiner* — Jonathan Bradford
(74) *Attorney, Agent, or Firm* — KED & ASSOCIATES

(57) ABSTRACT

In one embodiment, a refrigerator comprises a plurality of ice makers configured to generate ice, a valve part configured to adjust a supply of water to each of the plurality of ice makers, and a controller configured to control the valve part, and when receiving a request for a supply of water to an ice maker of higher priority while water is supplied to an ice maker of lower priority, the controller controls the valve part to cut off the supply of water to the ice maker of lower priority and supply water to the ice maker of higher priority.

11 Claims, 8 Drawing Sheets

REFRIGERATOR HAVING A PLURALITY OF ICE MAKERS

CROSS-REFERENCE TO RELATED APPLICATION

This application claims priority to and the benefit of Korean Patent Application No. 10-2022-0013468, filed in Korea on 2022 Jan. 28, the disclosure of which is incorporated herein by reference in its entirety.

BACKGROUND

1 Field

Disclosed herein is a refrigerator with a plurality of ice makers.

2. Background

Refrigerators generate cold air by circulating refrigerants and provide the cold air to a storage compartment such as a refrigerating compartment or a freezing compartment, to store various types of storage targets for a long period of time and keep the storage targets fresh in the storage compartment.

Refrigerators operate based on a refrigeration cycle in which refrigerants pass through a compressor, a condenser, an expansion valve and an evaporator. The temperature of the air circulating in the refrigerator is lowered while refrigerant liquids turn into refrigerant gases in the evaporator, such that cold air to be provided to the refrigerating compartment and the freezing compartment is generated.

In recent years, refrigerators that receive water from the outside and automatically supply the supplied water to a dispenser, an ice maker and the like have been widely used.

In the case where a plurality of components that is supplied with water requests a supply of water at the same time, the amount and/or pressure of water that is supplied to each of the components can differ, causing inconvenience to users.

Additionally, to supply water to the ice maker and the like automatically, the amount of the supplied water needs to be found. However, in the case where the plurality of components that is supplied with water requests a supply of water at the same time as described above, it is difficult to know the amount of water supplied to each of the components.

Further, in the case where water is supplied to the plurality of components at the same time, a plurality of loads (e.g., valves) can operate at the same time, causing a rapid increase in the electricity consumption and loss and damage to various types of components.

BRIEF DESCRIPTION OF THE DRAWINGS

Arrangements and embodiments may be described in detail with reference to the following drawings in which like reference numerals refer to like elements and wherein:

FIG. 3 is a front view showing the refrigerator of one embodiment, and the front surface of the refrigerator without doors, selves, drawers and the like;

DETAILED DESCRIPTION

Figure 1:
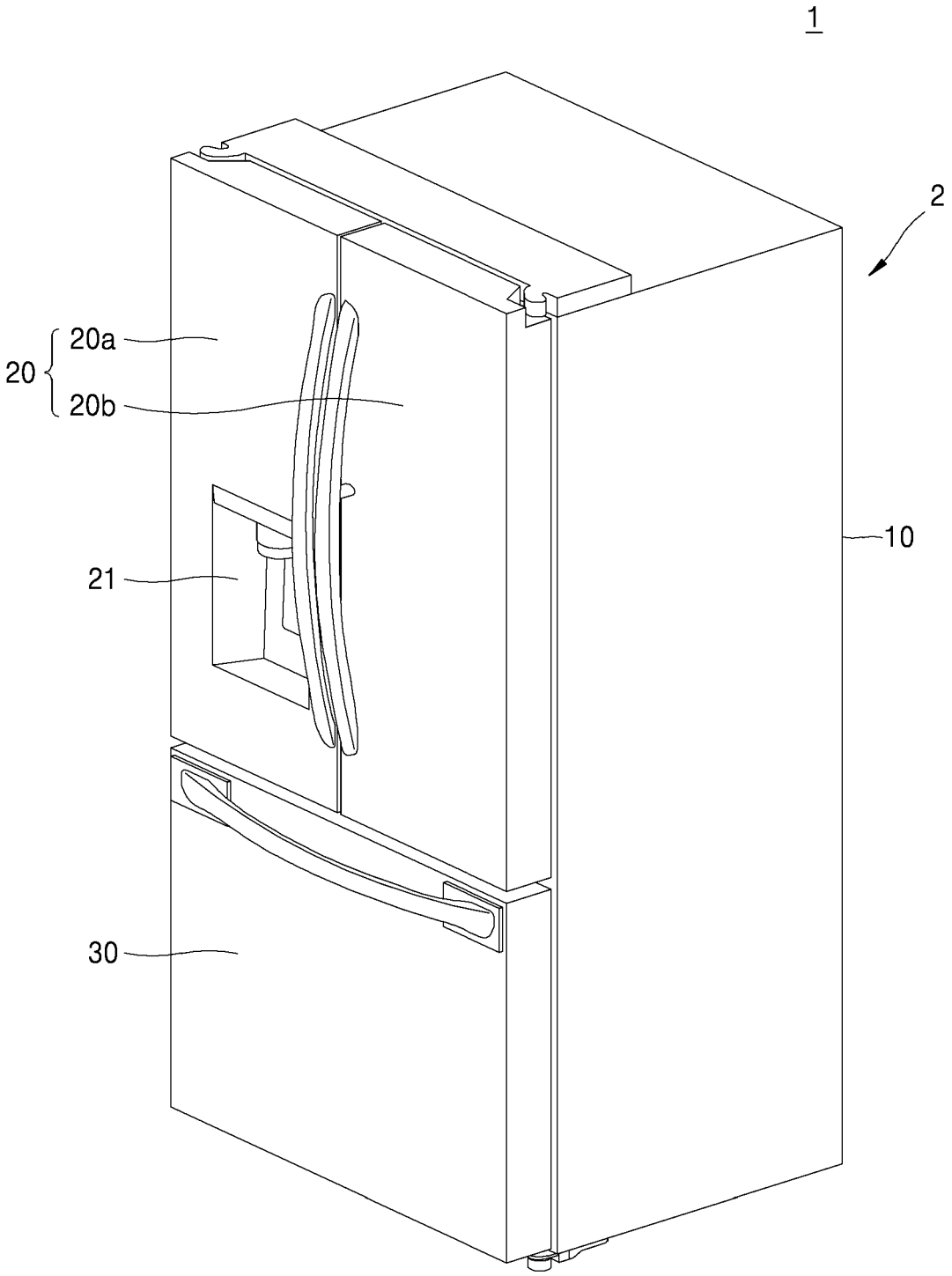
FIG. 1 is a front perspective view showing a refrigerator of one embodiment with doors closed.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

When any one component is described as being "in the upper portion (or lower potion)" or "on (or under)" another component, any one component can be directly on (or under) another component, but an additional component can be interposed between any one component and another component on (or under) any one component.

When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the phrase "A and/or B" as used herein can denote A, B or A and B, and the phrase "C to D" can denote C or greater and D or less, unless stated to the contrary.

Hereafter, a refrigerator of several embodiments is described.

Figure 2:
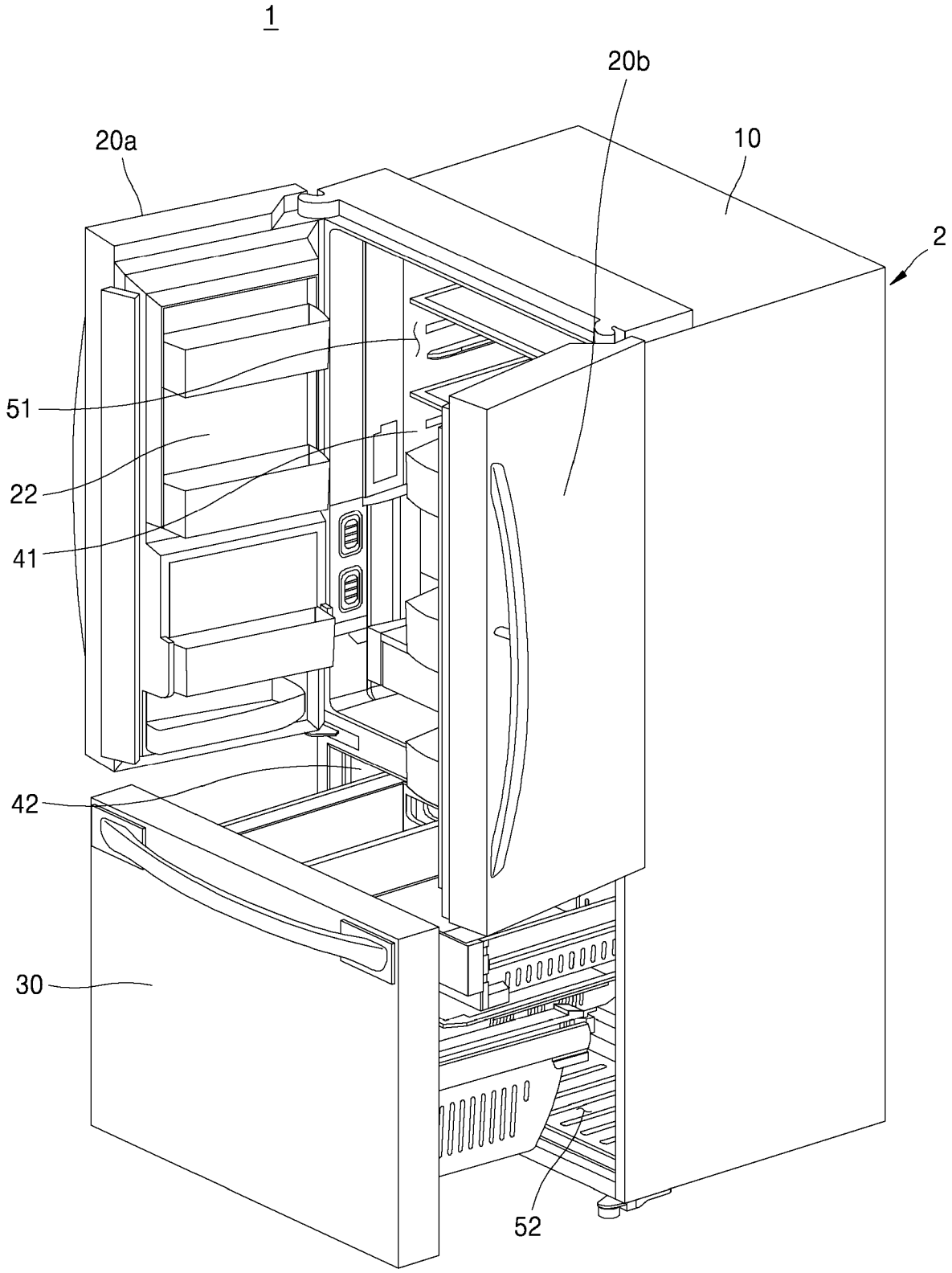
FIG. 2 is a front perspective view showing the refrigerator of one embodiment with the doors open.

FIG. 1 is a front perspective view showing a refrigerator 1 of one embodiment with doors closed, and FIG. 2 is a front perspective view showing the refrigerator 1 of one embodiment with the doors open.

The exterior of the refrigerator 1 of one embodiment may be formed by a cabinet 2 forming a storage space, and doors opening and closing the front surface of the cabinet 2, which is open.

The cabinet 2 may comprise an outer case 10 forming the outer surface of the refrigerator 1, and an inner case forming the inner surface of the refrigerator 1. The inner case may comprise a refrigerating case 41 and a freezing case 42.

A separation space may be formed between the outer case 10 and the inner case 41, 42 that are spaced from each other. An insulation material may foam in the separation space and fill the vacant space.

The storage space in the cabinet 2 may be portioned into a plurality of spaces, and divided into a refrigerating compartment 51 and a freezing compartment 52.

According to the present disclosure, the freezing compartment 52 is disposed in the lower space of the cabinet 2, and the refrigerating compartment 51 is disposed in the upper space of the cabinet 2, in an example.

A door may connect to the front surface of the cabinet 2, and open and close the refrigerator 1.

An upper door 20 may be disposed on the front surface of the cabinet 2, which corresponds to the refrigerating compartment 51, and a lower door 30 may be disposed on the front surface of the cabinet 2, which corresponds to the freezing compartment 52.

For example, the upper door 20 may be a rotary one comprised of a first upper door 20*a* and a second upper door 20*b* that respectively have a rotation shaft disposed at both sides of the cabinet 2 and rotate.

The lower door 30 may be a drawer-type one that moves to be drawn or inserted along a rail, in a sliding manner.

A dispenser part 21 may be disposed at the first upper door 20*a* such that water or ice may be taken out in the state where the door is not open. Additionally, a door ice maker 22 generating ice may be disposed at the first upper door 20*a* at which the dispenser part 21 is disposed.

The refrigerating compartment 51 may be divided into a first storage compartment 51*a* and a second storage compartment 51*b*.

The second storage compartment 51*b* may be a pantry compartment the temperature of which is adjusted to accommodate a specific storage target such as vegetables, meat and the like.

The first storage compartment 51*a* may be a remaining space of the refrigerating compartment 51, except for the second storage compartment 51*b*, and may be a main storage compartment.

For example, the second storage compartment 51*b* may be disposed under the first storage compartment 51*a* and be separated from the first storage compartment 51*a* by an additional partition member.

A storage drawer may be disposed in the second storage compartment 51*b* in a way that the storage compartment is drawn or inserted along a rail, in a sliding manner.

Additionally, a storage drawer and/or a shelf is provided in the first storage compartment 51*a* to accommodate and store a storage target readily.

The first storage compartment 51*a* and the second storage compartment 51*b* may respectively be provided with an additional temperature sensor, such that the temperatures of the first storage compartment 51*a* and the second storage compartment 51*b* are adjusted independently, enabling the first storage compartment 51*a* and the second storage compartment 51*b* to have a different temperature.

Figure 3:
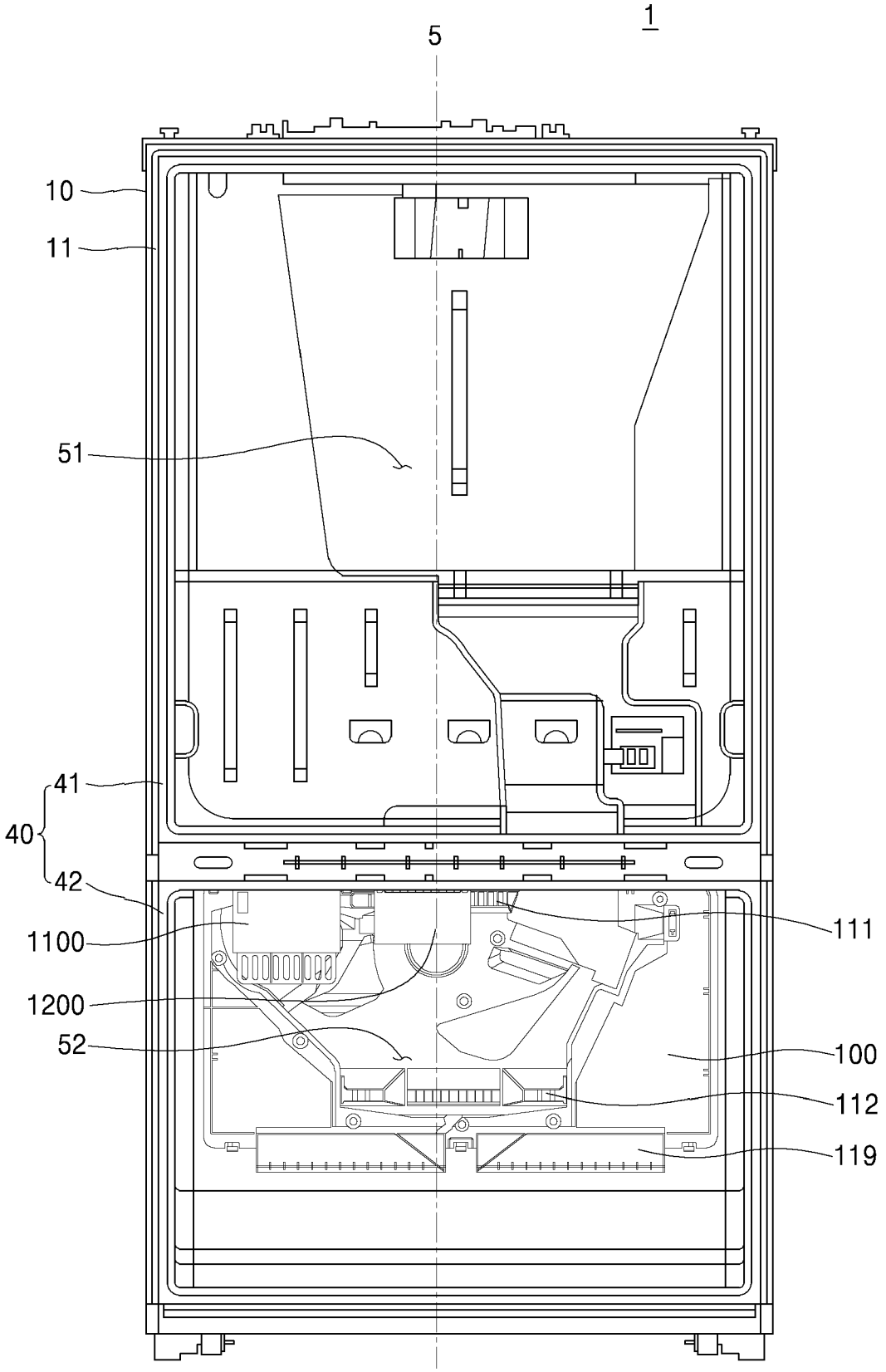
Figure 4:
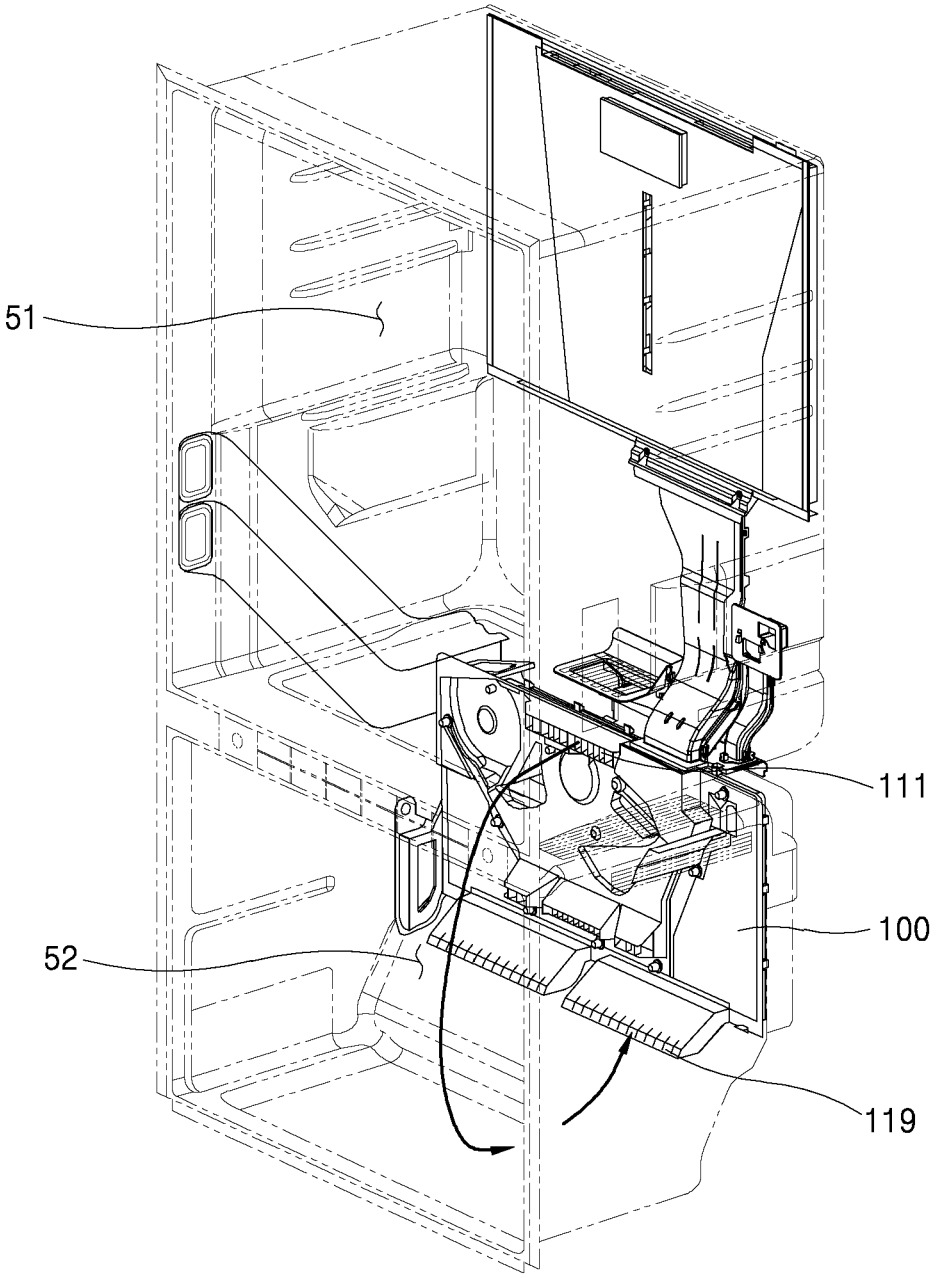
FIG. 4 is a front perspective view showing a cold air circulation structure of a freezing compartment.
Figure 5:
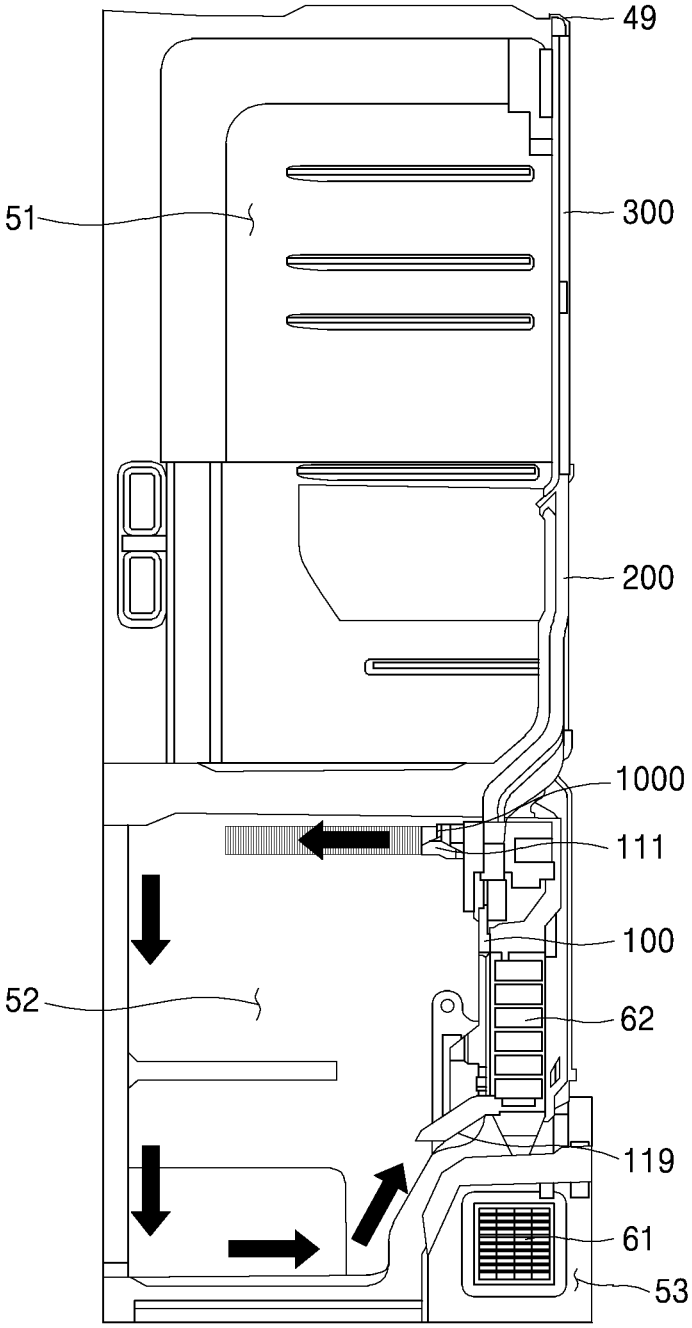
FIG. 5 is a cross-sectional view showing a cold air return structure of a freezing compartment.

FIG. 3 is a front view showing the refrigerator of one embodiment, and the front surface of the refrigerator without doors, selves, drawers and the like, FIG. 4 is a front perspective view showing a cold air circulation structure of a freezing compartment, and FIG. 5 is a cross-sectional view showing a cold air return structure of a freezing compartment and is a lateral cross-sectional view along line 5 in FIG. 3.

The inner case 40 may comprise a refrigerating case 41 being disposed in the upper portion of the refrigerator and constituting the refrigerating compartment 51, and a freezing case 42 being disposed in the lower portion of the refrigerator and constituting the freezing compartment 52. The refrigerating case 41 may form the refrigerating compartment 51, and the freezing case 42 may form the freezing case 52. A refrigerating compartment cold air supply duct 300 for supplying cold air to the refrigerating compartment 51 may be disposed in the upper portion of the rear surface of the refrigerating case 41. A controller (not illustrated) that sets a set value and the like required for the operation of the refrigerator 1 may be disposed on one lateral surface of the refrigerating case 41. A grille fan assembly 1000 may be disposed on the rear surface of the freezing case 42. The grille fan assembly 1000 may comprise a grille fan upper outlet 111 and a grille fan lower outlet 112 that discharge cold air to the freezing compartment 52, and an inlet 119 into which cold air in the freezing compartment 52 is suctioned.

Cold air generated by the evaporator 62 may be supplied to both the refrigerating compartment 51 and the freezing compartment 52.

In the case where a door ice maker 22 is additionally provided at the upper door 20 of the refrigerator 1, cold air generated by a single evaporator 62 may be supplied to all of the refrigerating compartment 51, the freezing compartment 52 and the door ice maker 22.

The evaporator 62 generating cold air may be disposed in the freezing compartment 52. Specifically, the evaporator 62 may be disposed on the rear surface of the freezing case 42.

The evaporator 62 may be disposed over a machine room 53.

The machine room 53 may be provided at the rear side of the lower portion of the freezing case 42 and provide a space in which a compressor 61 and a condenser are installed.

The rear space of the lower side in the freezing compartment 52 may have a smaller freezer space than the rear space of the upper side in the freezing compartment 52, because of the space occupied by the machine room 53.

That is, the area of the upper surface of the freezing case may be greater than the area of the lower surface of the freezing case.

Accordingly, the area of the upper side of the freezing compartment 52 may protrude further rearward than the area of the lower side of the freezing compartment 52, and the evaporator 62 may be disposed in the rear space of the upper side of the freezing compartment 52.

The grille fan assembly 100 may be disposed on the front surface of the evaporator 62. The grille fan assembly 100 blows cold air generated from the evaporator 62 to the refrigerating compartment 51 and the freezing compartment 52.

If the upper door 20 of the refrigerator 1 is provided with a door ice maker 22, cold air generated from a single evaporator 62 may be blown to all of the refrigerating compartment 51, the freezing compartment 52, and the door ice maker 22 from a single grille fan assembly 100.

To blow cold air to the refrigerating compartment cold air supply duct 300 supplying cold air to the refrigerating compartment 51, a connection duct (not illustrated) may be additionally disposed between the grille fan assembly 100 and the refrigerating compartment cold air supply duct 300.

For the refrigerator 1 to have a thermal insulation effect, an insulation material 11 exhibiting a very low heat conductivity may foam between the inner case 40 and the outer case 10 and fill a space between the inner case 40 and the outer case 10.

Hereafter, the flow of cold air in the freezing compartment is described.

Cold air, which is generated from the evaporator 62 disposed in the freezing compartment 52, may be supplied to the freezing compartment 52 by the grille fan assembly 100 disposed in the freezing compartment 52.

The grille fan assembly 100 may comprise a grille fan upper outlet 111 that discharges cold air toward the front surface of the freezing compartment 52 in the upper area of the freezing compartment 52.

Cold air, which is discharged toward the front surface of the freezing compartment 52, in the upper area of the freezing compartment 52, circulates in the freezing compartment 52, and returns toward the rear surface of the freezing compartment 52, in the lower area of the freezing compartment 52.

Since the machine room 53 is provided at the rear side of the lower portion of the freezing compartment 52, the rear surface of the lower side of the freezing compartment 52 may be an inclined surface that is formed at a slant from the lower portion thereof toward the upper portion thereof.

Thus, in the lower area of the freezing compartment 52, cold air, returning toward the rear surface of the freezing compartment 52, may be drawn and returned into the cold air inlet 119 of the grille fan assembly 100, along the inclined surface of the rear surface of the freezing compartment 52.

Figure 6:
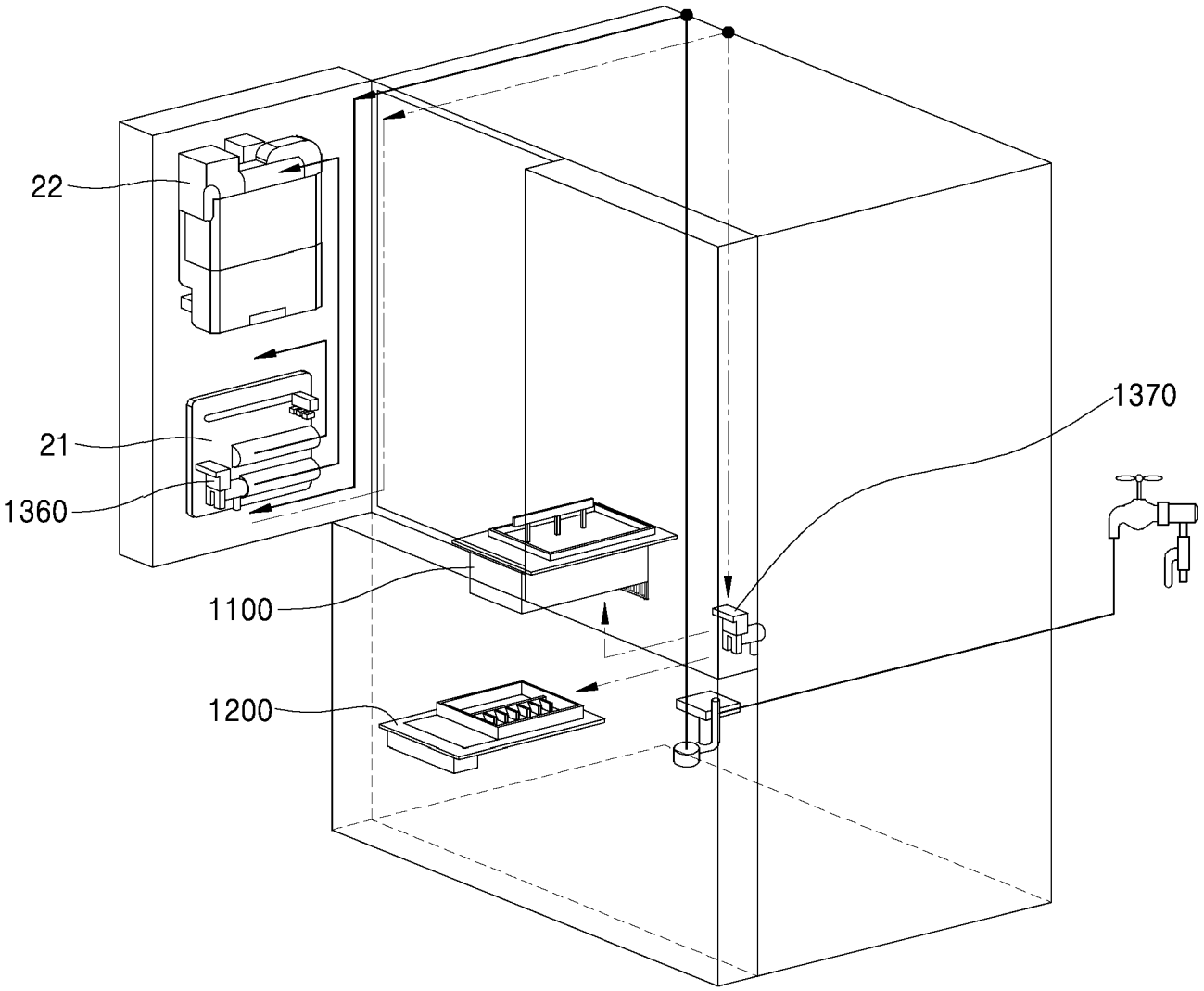
FIG. 6 is a schematic view showing a water supply system of the refrigerator of one embodiment.

FIG. 6 is a schematic view showing a water supply system of a refrigerator of one embodiment, and the refrigerator of one embodiment may comprise a dispenser 21, a door ice maker 22, a first ice maker 1100, a second ice maker 1200 and valves 1360, 1370.

Water supplied from an external water supply source is supplied to the dispenser 21, the door ice maker 22, the first ice maker 1100, and the second ice maker 1200, through a pipe and a valve (1360 or 1370).

The dispenser 21 may be disposed at a door of the refrigerator. In one embodiment, the dispenser 21 may be disposed at the first upper door 20*a* but not limited. The dispenser 21 may discharge water, based on the user's input. The user's input may comprise the user's manipulation of a switch, or a sensor's sensing of the user, a cup and the like.

The door ice maker 22 may be disposed at a door of the refrigerator. In one embodiment, the door ice maker 22 may be disposed at the first upper door 20*a* but not limited. The door ice maker 2 may generate ice by using supplied water, and store the generated ice.

The first ice maker 1100 may be disposed at the freezing compartment. For example, the first ice maker 1100 may be fixed to the upper surface of the freezing compartment. The first ice maker 1100 may generate ice that is relatively large and spherical. To this end, the first ice maker 1100 may comprise an upper chamber that has an inlet into which water is drawn, in the upper portion thereof, and has a hemispherical shape, and a lower chamber that contacts the upper chamber to form a spherical chamber and has a hemispherical shape.

The second ice maker 1200 may be disposed at the freezing compartment. For example, the second ice maker 1200 may be fixed to the upper surface of the freezing compartment in a way that the second ice maker 1200 is spaced from the first ice maker 1100. The second ice maker 1200 may generate ice that is relatively small and entirely has a cuboid shape. To this end, the second ice maker 1200 may comprise a tray having a plurality of ice making grooves that accommodate water. Ice, generated in the second ice maker 1200, may have a size to the degree that the user chews the ice easily. For example, ice, generated in the second ice maker 1200, may have a thickness of about 12 mm.

The valves 1360, 1370 may supply water to any one of the dispenser 21, the door ice maker 22, the first ice maker 1100 and the second ice maker 1200 or cut off a supply of water to any one of the dispenser 21, the door ice maker 22, the first ice maker 1100 and the second ice maker 1200, under the control of the controller.

Though not illustrated, a hinge may be disposed at a pipe near the boundary of the first upper door 20*a*, among pipes.

FIG. 6 shows a refrigerator comprising a single dispenser and three ice makers, for example. However, the number of dispensers and the number of ice makers may be adjusted if necessary. That is, some of the dispenser and the three ice makers may be omitted.

Figure 7:
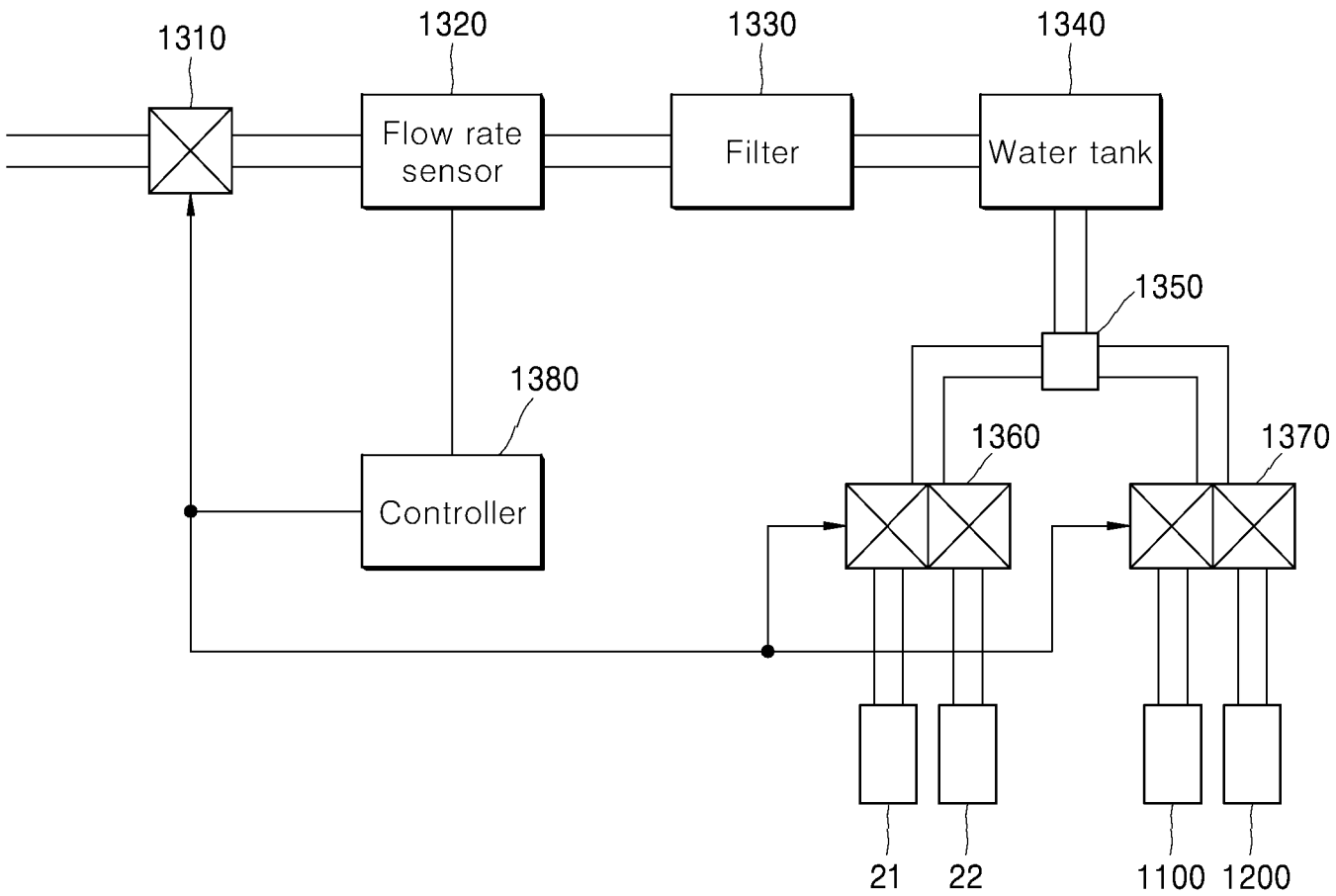
FIG. 7 is a block diagram showing the configuration of the refrigerator of one embodiment.

FIG. 7 is a block diagram showing the configuration of the refrigerator of one embodiment, and the refrigerator of one embodiment may comprise a dispenser 21, a door ice maker 2, a first ice maker 1100, a second ice maker 1200, a flow rate sensor 1320, a filter 1330, a water tank 1340, a connection pipe 1350, a first valve 1310, a second valve 1360, a third valve 1370 and a controller 1380.

The dispenser 21, the door ice maker 22, the first ice maker 1100, and the second ice maker 1200 may be the same as those described with reference to FIGS. 1 to 6.

The flow rate sensor 1320 may measure the amount of water flowing through a pipe, and supply the measured flow rate to the controller 1380. The flow rate sensor 1320 may be disposed at the rear end of the first valve 1310. For example, the flow rate sensor 1320 may be disposed between the first valve 1310 and the water tank 1340. The flow rate sensor 1320 may be disposed in the machine room in which the compressor and the like is disposed.

The filter 1330 may remove foreign substances in water flowing through the pipe. The filter 1330 may be disposed at the front end of the water tank 1340. Specifically, the filter 1330 may be disposed between the flow rate sensor 1320 and the water tank 1340.

The water tank 1340 may store water filtered through the filter 1330 temporarily. The water tank 1340 may be disposed at the refrigerating compartment 51.

Each of the valves 1310, 1360, 1370 may be opened and closed under the control of the controller 1380. The first valve 1310 may be disposed between an external water supply source and the flow rate sensor 1320. The second valve 1360 may supply water to the dispenser 21 or the door ice maker 22 or cut off a supply of water to the dispenser 21 and the door ice maker 22. The third valve 1370 may supply water to the first ice maker 1100 or the second ice maker 1200, or cut off a supply of water to the first ice maker 1100 and the second ice maker 1200.

FIG. 7 shows a refrigerator comprising three valves, for example. However, the number of valves may be adjusted properly. For example, the refrigerator may comprise four valves that are disposed to correspond to the dispenser 21, the door ice maker 22, the first ice maker 1100, and the second ice maker 1200 on a one-to-one basis.

A pipe through which water discharged from the water tank 1340 flows, a pipe through which water to be drawn into the second valve 1360 flows, and a pipe through which water to be drawn into the third valve 1370 flows may connect through the connection pipe 1350.

The controller 1380 may control the valves 1310, 1360, 1370 in response to a flow rate input from the flow rate sensor 1320, and a signal of a supply of water to the dispenser 21, the door ice maker 22, the first ice maker 1100 and the second ice maker 1200. When receiving a request for a supply of water to an ice maker that is given top priority while water is supplied to any one of the door ice maker 22, the first ice maker 1100 and the second ice maker 1200, the controller 1380 may cut off the supply of water to the ice maker to which water has been supplied, and control the valves 1310, 1360, 1370 such that water may be first supplied to the ice maker that is given top priority. Additionally, when receiving a request for a supply of water to the dispenser 21 while water is supplied to any one of the ice makers, the controller 1380 may cut off the supply of water to the ice maker and control the valves 1310, 1360, 1370 such that water may be first supplied to the dispenser 21.

The controller 1380 may comprise at least one processing unit and/or memory. The processing unit may comprise a central processing unit (CPU), a graphics processing unit (GPU), a microprocessor, an application-specific integrated circuit (ASIC), a field-programmable gate array (FPGA) and the like., for example, and may have a plurality of cores. Memory may be volatile memory (e.g., RAM and the like), non-volatile memory (e.g., ROM, flash memory and the like), or combinations thereof. The controller 1380 may comprise a micom where a processing unit and memory are embodied as a single chip.

Further, the controller 1380 may comprise additional storage. The additional storage may be flash memory. The additional storage may be mounted on a board on which a micom is mounted.

A computer-readable instruction for embodying one or more of the embodiments set forth in the present disclosure may be stored in the non-volatile memory or additional storage of the controller 1380. The computer-readable instructions stored may be loaded on the memory, to be executed by a processing unit.

Figure 8:
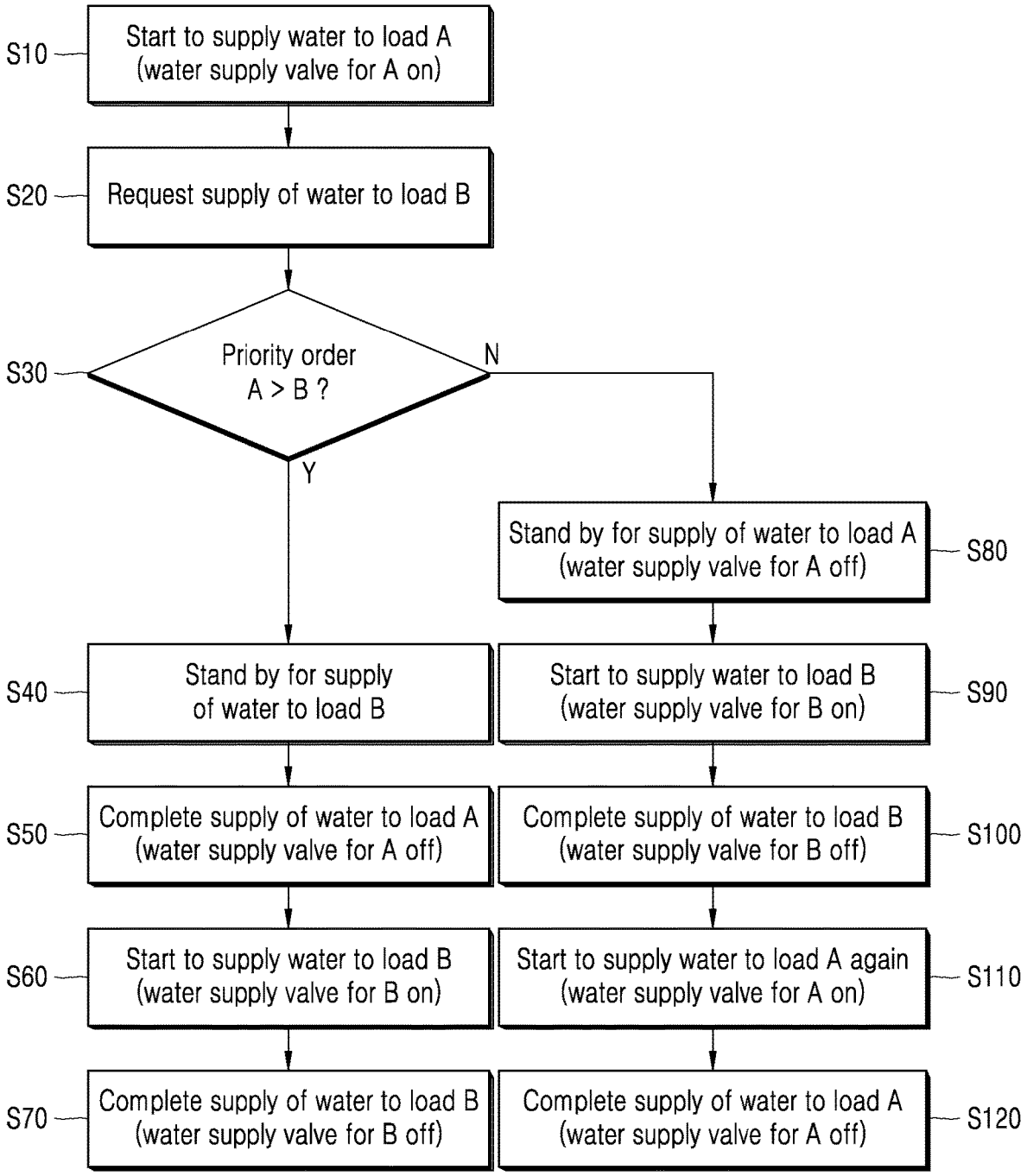
FIG. 8 is a flow chart for describing a control method of the refrigerator of one embodiment.

FIG. 8 is a flow chart for describing a control method of the refrigerator of one embodiment. Each step in FIG. 8 may be performed by the controller 1380 in FIG. 7.

In FIG. 8, load A may be any one of the dispenser 21, the door ice maker 22, the first ice maker 1100, and the second ice maker 1200, and load B may be any one of the other components, except for load A among the dispenser 21, the door ice maker 22, the first ice maker 1100, and the second ice maker 1200.

A control method of the refrigerator of one embodiment is described with reference to FIGS. 7 and 8.

In response to a request for a supply of water to load A, the controller 1380 may control the valves 1310, 1360, 1370 to supply water to load A (step 10). For example, in the case where the first ice maker 1100 is load A, the controller 1380 may open the first valve 1310, close the second valve 1360 and controls the third valve 1370 to supply water to the first ice maker 1100. At this time, the controller 1380 ay operate the third valve 1370 after opening the first valve 1310 completely.

In this state, at the request of a supply of water to load B (step 20), the controller 1380 may compare the priority of load A and the priority of load B (step 30).

In one embodiment, priority may be determined based on accuracy of the amount of supplied water, considering user convenience above all.

In one embodiment, priority may be given to the dispenser 21, the first ice maker 1100, the second ice maker 1200 and then the door ice maker 22, consecutively.

The dispenser 21 is usually used when the user wants immediate intake of water, and a delay in the discharge of water through the dispenser 21 causes inconvenience to the user, and user satisfaction deteriorates. To prevent this from happening, first priority may be given to the dispenser 21 in one embodiment.

The first ice maker 1100, as described above, may generate spherical ice. To generate spherical ice, the amount of water supplied needs to be controlled precisely. A shortage of water supplied may result in generation of non-spherical ice, and a surplus of water supplied may result in a destruction of an ice making tray. Thus, in one embodiment, second priority may be given to the first ice maker 1100.

The second ice maker 1200, as described above, may generate ice that is relatively small. For example, the second ice maker 1200 may be mounted to generate ice small enough for the user to chew. In the case where a large amount of water is supplied to the second ice maker 1200, the intended purpose may not be achieved. In the case where a small amount of water is supplied to the second ice maker 1200, ice may be too small. That is, when the amount of water supplied to the second ice maker 1200 is controlled inaccurately, a component may not be damaged as a component of the first ice maker 1100 is damaged. However, the second ice maker 1200 may not generate desired ice and serve a desired purpose, causing inconvenience. Additionally, the second ice maker 1200 may require less accuracy of the amount of supplied water than the first ice maker 1100. Thus, in one embodiment, third priority may be given to the second ice maker 1200.

The door ice maker 22 may generate ice that is relatively non-uniform in its size and shape. Thus, in one embodiment, fourth priority may be given to the door ice maker 22.

In the case where the priority of load B is lower than the priority of load A, the controller 1380 may withhold a supply of water to load B, and based on a flow rate output from the flow rate sensor 1320, supply a predetermined amount of water to load A (step 40).

As the supply of water to load A is completed, the controller may control the valves 1310, 1360, 1370 not to supply water to load A (step 50), and after the control in step 50 is completed, control the valves 1310, 1360, 1370 to supply water to load B (step 60). After supplying a predetermined amount of water to load B, the controller may close the valves 1310, 1360, 1370 (step 70). In step 50, the first valve 1310 may remain open.

For example, in the case where the first ice maker 1100 is load A and the door ice maker 22 is load B, the controller 1380 may supply a predetermined amount of water to the first ice maker 1100 and then close the third valve 1370. After the third valve 1370 is closed, the controller 1380 may control the second valve 1360 to supply water to the door ice maker 22.

In the case where the priority of load B is higher than the priority of load A, the controller 1380 may end the supply of water to load A (step 80). That is, the controller may control the valves 1360, 1370 not to supply water to load A. In step 80, the controller 1380 may store the water that has been supplied to load A until the controller cuts off the supply of water to load A.

Then, the controller may control the valves 1360, 1370 to supply water to load B (step 90). As the supply of water to load B is completed, the controller may control the valves 1360, 1370 not to supply water to load B (step 100).

Then the controller may start to supply water to load A again (step 120).

After the supply of water to load A is completed, the controller may close the valves 1310, 1360, 1370 (step 130).

For example, in the case where the first ice maker 1100 is load A and the dispenser 21 is load B, the controller 1380 may close the third valve 1370 in step 80. After the third valve 1370 is closed, the controller 1380 may control the second valve 1360 to supply water to the dispenser 21 (step 90). As the supply of water to the dispenser 21 is completed, the controller 1380 may close the second valve 1360, and control the third valve 1370 to supply water to the first ice maker 1100 again.

In one aspect, provided is a refrigerator that can prevent a change in the pressure of water being discharged from a dispenser even if an ice maker and the dispenser request a supply of water at the same time.

In one aspect, provided is a refrigerator that can supply an accurate amount of water automatically to at least one or more ice makers and/or dispensers, all the time.

In one aspect, provided is a refrigerator that can accurately find the amount of water that is supplied to each component even if a plurality of components requests a supply of water at the same time.

In one aspect, provided is a refrigerator than can prevent electric overload and/or loss and damage to a component that can occur at a time when a plurality of components requests a supply of water at the same time.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via components and combinations thereof that are described in the appended claims.

A refrigerator of one embodiment may supply water consecutively based on priority at a time when a plurality of components requests a supply of water at the same time. At this time, top priority may be given to a supply of water requested by the user. If there is no the user's request, priority may be determined based on the amount of water that is supplied.

A refrigerator of one embodiment may control each valve such that each valve operates consecutively, at a time when a plurality of components requests a supply of water at the same time.

A refrigerator of one embodiment may supply water to an ice maker after the discharge of water from a dispenser is completed, at a time when the ice maker requests a supply of water while water is supplied to the dispenser.

At a time when a dispenser requests a supply of water while water is supplied to an ice maker, a refrigerator of one embodiment may cut off the supply of water to the ice maker temporarily and supply water to the dispenser, and after the discharge of water from the dispenser is completed, supply water again to the ice maker.

A refrigerator of one embodiment comprises a plurality of ice makers generating ice, a valve part adjusting a supply of water to each of the plurality of ice makers, and a controller controlling the valve part, and when receiving a request for a supply of water to an ice maker of higher priority while water is supplied to an ice maker of lower priority, the controller controls the valve part to cut off the supply of water to the ice maker of lower priority and supply water to the ice maker of higher priority.

In the refrigerator of one embodiment, the plurality of ice makers may comprise a first ice maker being disposed in a freezing compartment and generating spherical ice, and a second ice maker being disposed in the freezing compartment in a way that the second ice maker is spaced from the first ice maker and using a tray having a plurality of ice making grooves that accommodate water to generate ice, and when receiving a request for a supply of water to the first ice maker while water is supplied to the second ice maker, the controller may control the valve part to cut off the supply of water to the second ice maker and supply water to the first ice maker.

In the refrigerator of one embodiment, the plurality of ice makers may further comprise a door ice maker being disposed at a door of the refrigerator, and when receiving a request for a supply of water to the second ice maker while water is supplied to the door ice maker, the controller may control the valve part to cut off the supply of water to the door ice maker and supply water to the second ice maker.

In the refrigerator of one embodiment, the plurality of ice makers may comprise a first ice maker being disposed in the freezing compartment and generating spherical ice, and a door ice maker being disposed at a door of the refrigerator, and when receiving a request for a supply of water to the first ice maker while water is supplied to the door ice maker, the controller may control the valve part to cut off the supply of water to the door ice maker and supply water to the first ice maker.

In the refrigerator of one embodiment, the plurality of ice makers may comprise a second ice maker being disposed in the freezing compartment and using a tray having a plurality of ice making grooves that accommodate water to generate ice, and a door ice maker being disposed at a door of the refrigerator, and when receiving a request for a supply of water to the second ice maker while water is supplied to the door ice maker, the controller may control the valve part to cut off the supply of water to the door ice maker and supply water to the second ice maker.

The refrigerator of one embodiment may further comprise a dispenser which is disposed at a door of the refrigerator and from which water is discharged, and when receiving a request for a supply of water to the dispenser while water is supplied to the ice maker of higher priority, the controller may control the valve part to cut off the supply of water to the ice maker of higher priority and supply water to the dispenser.

The refrigerator of one embodiment may further comprise a flow rate sensor sensing a flow rate of water that is supplied from an external water supply source, and outputting a sensing signal, and the controller may control the valve part in response to the sensing signal.

In the refrigerator of one embodiment, the flow rate sensor may be disposed in a machine room in which a compressor is placed.

The refrigerator of one embodiment may further comprise a filter being disposed at a rear end of the flow rate sensor, and a water tank being disposed at a rear end of the filter and storing water temporarily.

In the refrigerator of one embodiment, the plurality of ice makers may comprise a first ice maker being disposed in the freezing compartment and generating spherical ice, a second ice maker being disposed in the freezing compartment in a way that the second ice maker is spaced from the first ice maker and using a tray having a plurality of ice making grooves that accommodate water to generate ice, and the valve part may comprise a three-way valve selectively supplying water being drawn through a pipe to the first ice maker or the second ice maker.

A refrigerator of one embodiment can prevent a change in the pressure of water that is discharged from a dispenser even if an ice maker and the dispenser request a supply of water at the same time.

The refrigerator of one embodiment can supply an accurate amount of water automatically to at least one or more ice makers and/or dispensers, all the time.

The refrigerator of one embodiment can accurately find the amount of water that is supplied to each component even if a plurality of components requests a supply of water at the same time.

The refrigerator of one embodiment can prevent electric overload and/or loss and damage to a component that can occur at a time when a plurality of components requests a supply of water at the same time.

Specific effects are described along with the above-described effects in the section of detailed description.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a plurality of ice makers configured to provide ice, the plurality of ice makers are to have different priorities, and the plurality of ice makers comprises a first ice maker disposed in a freezing compartment, and configured to provide spherical ice, and a second ice maker disposed in the freezing compartment and spaced from the first ice maker, and configured to provide ice by using a tray having a plurality of grooves to accommodate water;

a valve assembly configured to adjust a supply of water to each of the plurality of ice makers;

a flow rate sensor configured to sense a flow rate of water from an external water supply source, and to output a sensing signal; and a controller configured to control the valve assembly in response to the sensing signal, wherein, in response to receiving a water supply request for the first ice maker while water is supplied to the second ice maker, the controller is configured to cut off the supply of water to the second ice maker, to store, based on the sensing signal, an amount of the water that has been supplied to the second ice maker until the controller cuts off the supply of water to the second ice maker, and to supply water to the first ice maker, and wherein, in response to receiving a water supply request for the second ice maker while water is supplied to the first ice maker, the controller is configured to withhold a supply of water to the second ice maker, and to supply, based on the sensing signal, a predetermined amount of water to the first ice maker.

2. The refrigerator of claim 1, wherein the plurality of ice makers further comprises a door ice maker disposed at a door of the refrigerator, and wherein in response to receiving a water supply request for the second ice maker while water is supplied to the door ice maker, the controller is configured to control the valve assembly to cut off the supply of water to the door ice maker and to supply water to the second ice maker.

3. The refrigerator of claim 1, the plurality of ice makers further comprises a door ice maker disposed at a door of the refrigerator, wherein in response to receiving a water supply request for the first ice maker while water is supplied to the door ice maker, the controller is configured to control the valve assembly to cut off the supply of water to the door ice maker and to supply water to the first ice maker.

4. The refrigerator of claim 1, further comprising:

a dispenser disposed at a door of the refrigerator, and configured to discharge water, wherein in response to receiving a water supply request for the dispenser while water is supplied to any one of the plurality of ice makers, the controller is configured to control the valve assembly to cut off the supply of water to the any one of the plurality of ice makers and to supply water to the dispenser.

5. The refrigerator of claim 1, comprising a machine room, wherein the flow rate sensor and a compressor are disposed in the machine room.

6. The refrigerator of claim 1, comprising:

a filter configured to remove foreign substances in water; and a water tank configured to store water.

7. The refrigerator of claim 1, wherein the valve assembly includes a three-way valve configured to selectively supply water drawn through a pipe to the first ice maker or the second ice maker.

8. A refrigerator, comprising:

a plurality of ice makers configured to provide ice, the plurality of ice makers includes a first ice maker and a second ice maker;

a plurality of valves configured to control a supply of water to each of the plurality of ice makers;

a flow rate sensor configured to sense a flow rate of water from an external water supply source, and to output a sensing signal; and a controller configured to control the valves in response to the sensing signal, wherein the first ice maker is disposed in a freezing compartment, and configured to provide spherical ice, and the second ice maker is disposed in the freezing compartment and spaced from the first ice maker, and configured to provide ice by using a tray, wherein the controller is configured to control the valves to cut off the supply of water to the second ice maker, to store, based on the sensing signal, an amount of the water that has been supplied to the second ice maker until the controller cuts off the supply of water to the second ice maker, and to supply the water to the first ice maker, and wherein, in response to receiving a water supply request for the second ice maker while water is supplied to the first ice maker, the controller is configured to withhold a supply of water to the second ice maker, and to supply, based on the sensing signal, a predetermined amount of water to the first ice maker.

9. The refrigerator of claim 8, wherein the plurality of ice makers further comprises a door ice maker disposed at a door of the refrigerator, and wherein in response to receiving a water supply request for the second ice maker while water is supplied to the door ice maker, the controller is configured to control the valves to cut off the supply of water to the door ice maker and to supply water to the second ice maker.

10. The refrigerator of claim 8, wherein the plurality of ice makers further comprises a door ice maker disposed at a door of the refrigerator, and wherein in response to receiving a water supply request for the first ice maker while water is supplied to the door ice maker, the controller is configured to control the valve assembly to cut off the supply of water to the door ice maker and to supply water to the first ice maker.

11. The refrigerator of claim 8, further comprising:

a dispenser disposed at a door of the refrigerator, and configured to discharge water, wherein in response to receiving a water supply request for the dispenser while water is supplied to the second ice maker, the controller is configured to control the valve assembly to cut off the supply of water to the second ice maker and to supply water to the dispenser.

* * * * *